United States Patent [19]

Dennis

[11] 4,298,805

[45] Nov. 3, 1981

[54] REGULATOR FOR A PULSED NEUTRON SOURCE

[75] Inventor: Charles L. Dennis, Dallas, Tex.

[73] Assignee: Mobil Oil Corporation, New York, N.Y.

[21] Appl. No.: 134,376

[22] Filed: Mar. 27, 1980

[51] Int. Cl.[3] ..... G21G 4/02

[52] U.S. Cl. ..... 376/111

[58] Field of Search ..... 250/502, 501, 500, 499

[56] References Cited

U.S. PATENT DOCUMENTS 3,719,827 3/1973 Dennis ..... 250/502

3,984,694 10/1976 Dennis ..... 250/502

*Primary Examiner*—Harold A. Dixon

*Attorney, Agent, or Firm*—Charles A. Huggett; Michael G. Gilman; George W. Hager

[57] ABSTRACT

A pulsed neutron system including an accelerator tube having a target, an ionization section, and a replenisher section for supplying accelerator gas. An ionization circuit includes means for applying repetitive ionization pulses to the ionization section. The current in the ionization circuit is monitored in order to detect incremental current events occurring during the ionization pulses. A count rate function is produced which is representative of the frequency of the incremental current events. The power supplied to the replenisher section is controlled in response to the count rate function. The replenisher power is increased in response to a decrease in the count rate function and decreased in response to an increase in the count rate function.

5 Claims, 2 Drawing Figures

REGULATOR FOR A PULSED NEUTRON SOURCE

BACKGROUND OF THE INVENTION

This invention relates to pulsed neutron logging systems and more particularly to a method and apparatus for controlling the operation of an accelerator-type pulsed neutron source.

Accelerator-type pulsed neutron sources are employed in many applications. A well-known application is in radioactivity logging of wells penetrating subterranean formation. For example, in the art of radioactive assay well logging, an assay tool is lowered into the well to the level of a formation to be assayed. The assay operation is then carried out by cyclically operating a neutron source in the tool in order to irradiate the formation with repetitive bursts of neutrons. In one assay procedure disclosed in U.S. Pat. No. 3,686,503 to Givens et al, the time between each neutron burst is sufficient to allow the neutrons from the source to disappear and to allow delayed fission neutrons emitted by uranium within the formation to arrive at and be detected by a neutron detector. Another procedure, disclosed in U.S. Pat. No. 4,180,730 to Givens et al, involves the detection of prompt fission neutrons emitted from uranium in the formation. In this procedure both thermal and epithermal neutron fluxes are detected at time intervals within 50 to several hundred microseconds subsequent to each neutron burst. In this case, the neutron source may be operated at a significantly higher rate, typically on the order of one or two thousand neutron bursts per second.

A pulsed neutron generator for systems such as those disclosed in the above-mentioned patents to Givens et al commonly take the form of a three-element, linear accelerator tube. This tube includes a replenisher element which is electrically heated to boil off deuterium gas adsorbed by the filament. The deuterium molecules are ionized by an ionizing section which commonly includes plates to which a positive ionization pulse is applied. The deuterium ions are then accelerated and bombard a target which included tritium molecules. The bombardment of the deuterium ions on the tritium molecules yields helium plus a supply of neutrons. One commercially available tube which is capable of such operation is the Kaman Nuclear Model A-801 Neutron Generator.

In operating such a tube it is important that the power supplied to the replenisher be correctly adjusted so that the proper amount of accelerator gas, deuterium, as described above, boils off the replenisher element. If the replenisher is overheated, too much accelerator gas boils off. In this case, ion recombination takes place in the tube. Also, arcing in the tube shortens the tube life and neutron output falls off. If too little power is supplied to the replenisher, there is not enough accelerator gas available in the tube to provide a good neutron output.

The adjustment of the power supply to the replenisher is complicated by the fact that the characteristics of the tube change as the tube ages. That is, after the tube has been in use, a greater amount of power must be supplied to the replenisher to boil off the same amount of accelerator gas. U.S. Pat. No. 3,719,827 to Charles L. Dennis describes a system in which the power supply to the replenisher element in a linear accelerator tube is automatically controlled. In this system, the time duration of the ionization pulse is compared to a reference pulse, and a control signal generated. The control signal is applied to a stepping motor. Each time the accelerator tube is ionized, the motor is advanced in one direction or the other, depending upon the comparison of the ionization pulse to the reference pulse. This motor increments a variable autotransformer which supplies power to the replenisher. In this manner the replenisher power is adjusted to supply the correct amount of accelerator gas to the tube.

U.S. Pat. No. 3,984,694 to Dennis describes another system for adjusting the power supply to the replenisher section of an accelerator-type neutron tube. In this system, first and second reference pulses are generated in response to the ionization pulse in order to delineate a time window within which acceptable operation of the tube is achieved. When the ionization pulse falls outside of the time window, the power supply is increased or decreased as necessary; for example, by operating a stepping motor to drive a variable autotransformer applying power to the replenisher as described above.

SUMMARY OF THE INVENTION

In accordance with the present invention, there is provided a new and improved process and system for controlling the operation of an accelerator-type neutron source based upon the detection of incremental current events which occur during ionization of the accelerator gas. In carrying out the invention the current through the ionization section is monitored in order to detect the incremental current events which occur during the ionization pulses applied to the ionization section. Based upon the frequency of the incremental current events, the power supplied to the replenisher is controlled in order to increase or decrease the amount of accelerator gas supplied by the replenisher, thereby increasing or decreasing the accelerator gas pressure within the tube. More specifically, the power supplied to the replenisher is increased in response to a decrease in the rate of occurrence of the incremental current events and decreased in response to an increase in the rate of occurrence of the incremental current events.

The system of the present invention includes a circuit means for the ionization section which includes a means for applying repetitive ionization pulses to the ionization section. The system further includes means for monitoring the current in this circuit and detecting incremental current events which occur during the ionization pulses applied to the ionization section. Means are provided to produce a count rate function which is representative of the rate of occurrence of the incremental current events. The count rate function is applied to control means which responds thereto to increase the supply power to the replenisher in response to a decrease in the count rate function and to decrease the power to the replenisher in response to an increase in the count rate function.

DESCRIPTION OF THE PREFERRED EMBODIMENT

Figure 1:
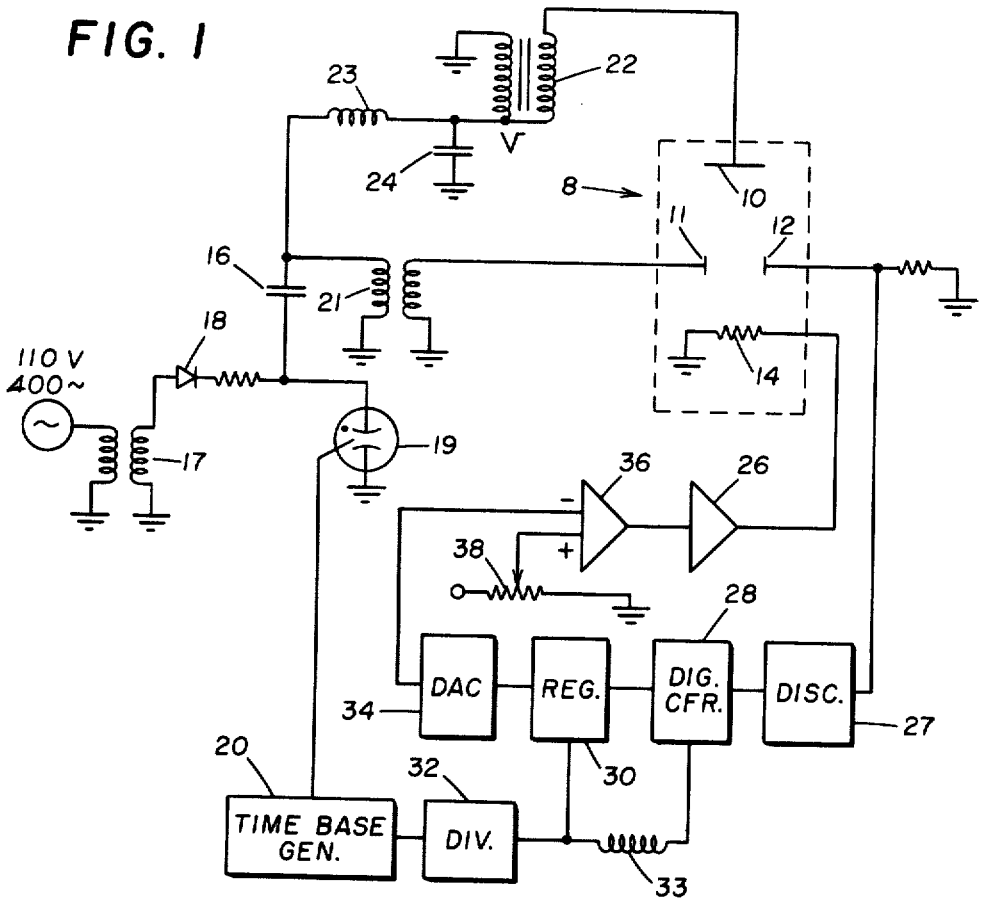
FIG. 1 is a schematic circuit diagram of the regulator system of the present invention for use in the control of the replenisher element of an accelerator tube in a pulsed neutron system.

Referring to FIG. 1, the pulsed neutron system includes an accelerator tube 8 having a target 10, an ionization section including plates 11 and 12, and a replenisher 14 for supplying accelerator gas.

Deuterium gas is emitted by the replenisher 14 in response to an applied voltage. The replenisher power supply make take the form of any suitable variable source such as a power amplifier as indicated by reference numeral 26. Amplifier 26 may supply either a DC or AC voltage to the replenisher element. The deuterium gas produced by the replenisher is ionized by an ionization pulse applied across the plates 11 and 12. The deuterium ions are accelerated toward the target 10 by a voltage pulse applied to the target. For example, the pulse applied to the ionization section may be a +2 kilovolt pulse and the pulse to the target 12 a −120 kilovolt pulse. Energy for the production of these pulses is stored in a storage capacitor 16. This energy is generated by a suitable source such as a 110-volt, 400-cycle source which is connected to the primary winding of a transformer 17. Rectified voltage by way of diode 18 is applied to the storage capacitor 16 which is periodically discharged by a switch which comprises a xenon-filled triggerable spark gap 19. A time base generator 20 generates triggering pulses which fire the spark gap 19 at any suitable intervals. For example, the pulse rate may range from a low of one or two pulses per second in the case of delayed fission neutron logging to several thousand pulses per second in the case of prompt fission neutron logging.

Each time the spark gap 19 is triggered, the energy stored in capacitor 16 is applied to the primary windings of transformers 21 and 22. The secondary winding of the transformer 21 produces the positive 2-kilovolt ionization pulse which is applied to the plates 11 and 12 to ionize the accelerator gas in the tube. These positive ions are then accelerated toward the target 10 by the −120 kilovolt acceleration pulse applied to the target. Since the ionization process requires a finite amount of time whereas the acceleration is relatively instantaneous, the acceleration pulse is delayed with respect to the ionization pulse. A delay line 23 provides approximately a 7 microsecond delay for the acceleration pulse relative to the ionization pulse. The delay line 23 also acts as a tuned circuit with capacitor 24. This circuit is tuned to most efficiently transfer energy from the storage capacitor 16 to the target 10 of the tube.

In accordance with the present invention there is provided a new and improved process and apparatus for regulating the power supply to the replenisher 14 of the accelerator tube. As noted previously the amount of gas emitted from the replenisher, and therefore the pressure of the replenisher gas within the tube, is a function of the power supplied to the replenisher element. If too much power is supplied to the replenisher, an overabundance of deuterium gas is boiled off resulting in an excessive accelerator gas pressure within the tube with the attendant disadvantages noted previously. On the other hand, if the power supplied to the replenisher element is too low the accelerator gas pressure within the tube is likewise too low for optimum neutron output from the tube.

The accelerator gas pressure within the neutron tube is related to an incremental current event which occurs during ionization of the accelerator gas. As the accelerator gas pressure increases above the desired level for optimum operation of the neutron tube, the frequency of these incremental current events also increases. When the accelerator gas pressure within the tube declines, the frequency of the incremental current events similarly declines.

The relationship between these incremental current events and the reservoir pressure may be illustrated by reference to a deuterium tritium neutron source of the general type described previously. More specifically, when pulsing the ionization section of the tube with a 2000 volt 20 microsecond pulse, the resulting current in the ionization section exhibits an event occurring about 5 microseconds after the inception of the ionization pulse when the gas pressure is at or near the optimum for maximum neutron output. This event or incremental pulse is about 3 microseconds in width and exhibits a current amplitude of about twice that of the overall ionization pulse. This incremental event does not occur for each ionization pulse if the accelerator gas pressure in the tube is low and occurs more than once when the gas pressure is above the optimum.

Figure 2:
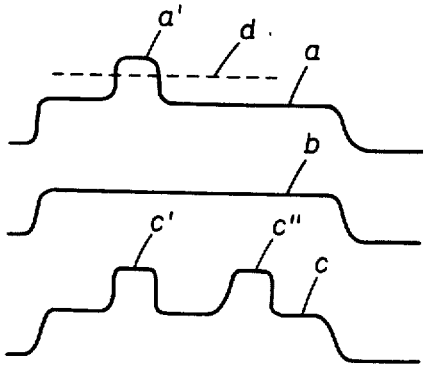
FIG. 2 illustrates a series of waveforms representative of the current appearing in the ionization section circuit during ionization of the accelerator gas.

Turning now to FIG. 2, the ionization pulses for the "optimum" pressure, low pressure, and high pressure conditions described previously are illustrated by the waveforms a, b and c. The ionization pulses illustrated are idealized representing an average of a repetitive number of ionization pulses for each of these pressure conditions. As illustrated by waveform a, the ionization pulse has a duration of about 20 microseconds and exhibits an incremental current pulse a′ which occurs about 5 microseconds after the start of the ionization pulse. Typically, the overall ionization pulse may exhibit a current amplitude of about 0.5 to 1 ampere and the current event a′ similarly has an incremental amplitude of 0.5 to 1 ampere above the remainder of the pulse. For the low pressure condition, illustrated by waveform b, the ionization pulse will be relatively constant throughout, i.e. the incremental current pulse found in waveform a is absent in the case of waveform b. In the case of the high pressure condition, illustrated by waveform c, two or more incremental current events are present, superimposed on the ionization pulse. For example, as shown by waveform c, two incremental current events, c′ and c″ are present, again having an incremental amplitude about the same as the amplitude of the ionization pulse c.

In the present invention, the current through the ionization current is monitored in order to detect the incremental current events occurring during ionization of the accelerator gas. Based upon the frequency of these incremental current events, the power supplied to the replenisher element is decreased or increased as necessary to maintain the desired accelerator gas pressure within the tube. More specifically and referring again to FIG. 1, the current in the circuit for the ionization section is monitored by means of a pulse height discriminator 27. The pulse height discriminator is set to reject current amplitudes below a level between the amplitude of the ionization pulse and the amplitude of the incremental current event, as indicated for example by the broken line d shown in FIG. 2. Thus, in response to a current in the ionization circuit above the discrimination level, the pulse height discriminator produces a pulse which increments a digital counter 28. The output from digital counter 28 is applied to a latch register 30 which together with the counter is under the control of the time base generator 20.

In the preferred embodiment of the invention illustrated, the output from the time base generator is applied through a divider so that the digital value stored in the latch register represents an average value obtained over a plurality of cycles of operation, preferably within the range of 10 to 100 ionization bursts. For example, the output of time base generator 20 may be applied through a decade divider 32 to counter 28 and latch register 30. Thus, for each 10 trigger pulses from the time base generator, a pulse is generated by the decade divider 32 and applied to latch register 30 to hold the value recorded by digital counter 28. The pulse from divider 32 is also applied through a suitable time delay line 33 to reset digital counter 28 to zero. For example, delay line 33 may produce a 10 microsecond delay in order to ensure that the output from the counter 28 is fixed in latch register 30 before resetting of the counter.

The output from latch register 30 is applied to a digital-to-analog converter 34 which produces an analog voltage proportional to the digital value fixed in register 30. This voltage is maintained until the next succeeding output from decade divider 32 and is applied to the negative terminal of an operational amplifier 36. A suitable reference voltage is applied through a potentiometer 38 to the positive input of the operational amplifier to provide a reference value about which replenisher power is increased or decreased. Thus, in accordance with the preferred embodiment of the invention the reference voltage applied to the operational amplifier is equal to the output from the digital to analog converter 34 where one incremental current event is detected for each ionization pulse, i.e. in the embodiment illustrated, the value in latch register 30 would be 10. As the frequency of incremental current events increases about one per ionization pulse, the analog output from converter 34 is increased thus reducing the output signal from operational amplifier 36. This is applied to power amplifier 26, decreasing the voltage applied to replenisher element 14. Similarly, should the frequency of incremental current events fall below one for each ionization pulse the output from converter 34 is decreased and the signal from the operational amplifier 36 is increased to provide an increased voltage from the power amplifier to the replenisher element.

While the circuitry illustrated in FIG. 2 is preferred in carrying out the present invention, it will be recognized that other suitable means may be employed in order to arrive at a count rate function which is representative of the frequency of the incremental current events. For example, the output from the pulse height discriminator 27 may be applied to a pulse shaper (not shown) which produces constant amplitude, constant duration pulses. In this case the counter 28, register 30 and converter 34 could be replaced with an RC averaging circuit having a time constant such that the constant amplitude, constant duration pulses from the pulse height discriminator produce a voltage signal representative of the frequency of incremental current events over a desired number of cycles of operation. For example, by analogy to the digital circuitry shown, the output from the RC averaging circuit would be equal to the reference voltage applied to the operational amplifier when ten incremental current events occur over ten cycles of operation.

I claim:

1. In a pulsed neutron system including an accelerator tube having a target, an ionization section, and a replenisher for supplying accelerator gas which is ionized by repetitive pulses applied to said ionization section, a method of adjusting the power supplied to the replenisher to control the pressure of the accelerator gas within said tube, comprising the steps of:

(a) monitoring the current through said ionization section and detecting current events occurring during said ionization pulses, (b) increasing the power supplied to said replenisher in response to a decrease in the frequency of said incremental current events to increase the amount of accelerator gas supplied by the replenisher thereby increasing said accelerator gas pressure, and (c) decreasing the power supplied to said replenisher in response to an increase in the frequency of said current events to decrease the amount of accelerator gas supplied by said replenisher thereby decreasing said accelerator gas pressure.

2. The method of claim 1 wherein the power of said replenisher is increased in response to an occurrence of less than one incremental current event per ionization pulse and decreased in response to an occurrence of more than one incremental current event per ionization pulse.

3. A pulsed neutron system comprising an accelerator tube having a target, an ionization section, and a replenisher for supplying accelerator gas comprising the combination of:

(a) a circuit for said ionization section including means for applying repetitive ionization pulses to said ionization section, (b) means for monitoring the current in said circuit and detecting incremental current events occurring during said ionization pulses, (c) means for producing a count rate function representative of the frequency of said incremental current events, and (d) means responsive to said count rate function for increasing the power supplied to said replenisher in response to a decrease in said count rate function and for decreasing the power to said replenisher in response to an increase in said count rate function.

4. The system of claim 3 wherein said count rate means produces a count rate function representative of the average frequency of incremental current events over a plurality of ionization pulses.

5. The system of claim 4 wherein said count rate function is representative of the average frequency of incremental current events over a number of ionization pulses within the range of 10–100.

* * * * *